United States Patent [19]

Schurman

[11] 4,005,800

[45] Feb. 1, 1977

[54] PLASTIC CONTAINER HINGE AND LATCH

[75] Inventor: Peter T. Schurman, Woodbridge, Conn.

[73] Assignee: The Plastic Forming Company, Inc., Woodbridge, Conn.

[22] Filed: Jan. 29, 1975

[21] Appl. No.: 545,142

Related U.S. Application Data

[62] Division of Ser. No. 288,707, Sept. 13, 1972, Pat. No. 3,902,628.

[52] U.S. Cl. ..... 220/337; 220/9 R

[51] Int. Cl.[2] ..... B65D 51/04; B65D 25/18

[58] Field of Search ..... 220/338, 337, 349, 345, 220/87 R, DIG. 26, 341, 342, 343, 337, 9 R; 150/46

[56] References Cited

UNITED STATES PATENTS

| | | | |
|---|---|---|---|
| 2,295,494 | 9/1942 | Valentine | 220/343 |
| 2,416,822 | 3/1947 | Crane | 220/94 R |
| 2,461,711 | 2/1949 | Wewetzer | 220/338 |
| 2,702,651 | 2/1955 | Graham | 220/338 |
| 2,842,178 | 7/1958 | Solomon | 150/46 |
| 2,960,254 | 11/1960 | Kiba | 220/338 |
| 3,045,860 | 7/1962 | Harvey | 220/338 |
| 3,339,781 | 9/1967 | Schurman et al. | 206/349 |
| 3,497,908 | 3/1970 | Zamarra | 220/338 |
| 3,524,564 | 8/1970 | Schurman | 220/87 R |
| 3,651,992 | 3/1972 | Hazard | 220/266 |
| D145,008 | 6/1946 | Crane | 220/343 |

*Primary Examiner*—George E. Lowrance
*Assistant Examiner*—Allan N. Shoap
*Attorney, Agent, or Firm*—Christel & Bean

[57] ABSTRACT

Blow-molded plastic container body and cover parts are hinged together by a cover joint formation integrally formed thereon and received in a body trough formation having sockets at the opposite ends thereof receiving hinge pins integrally formed at the opposite ends of the cover joint formation. A tapered latch tongue formed integral with the cover is received in snap-fitted engagement with a tapered latch receiving formation on the body for releasably latching the cover and body parts in closed position.

6 Claims, 14 Drawing Figures

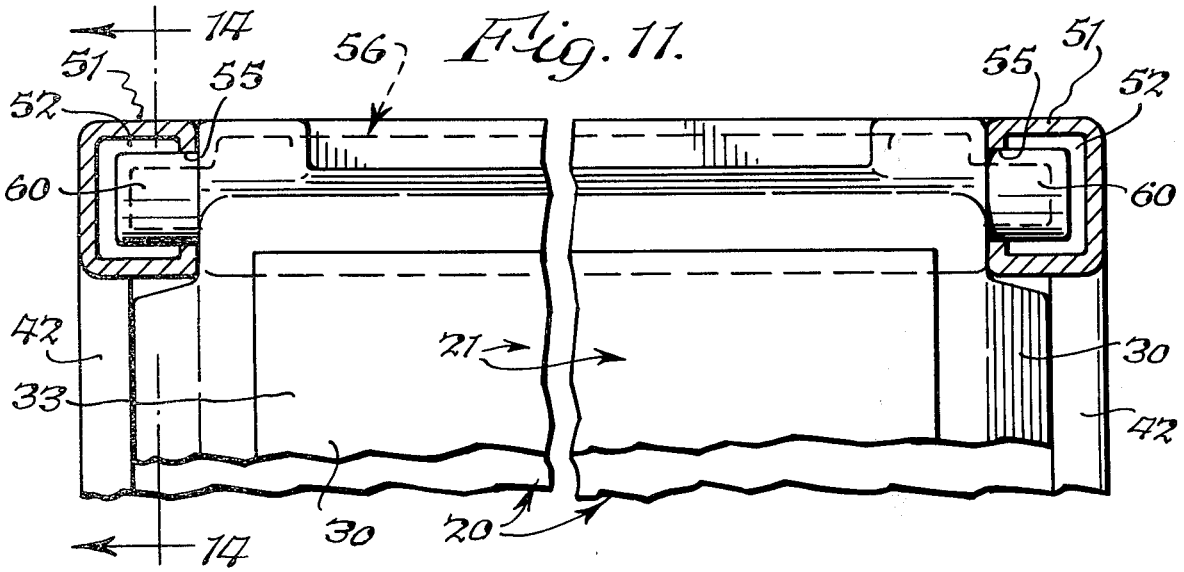
Fig. 11.
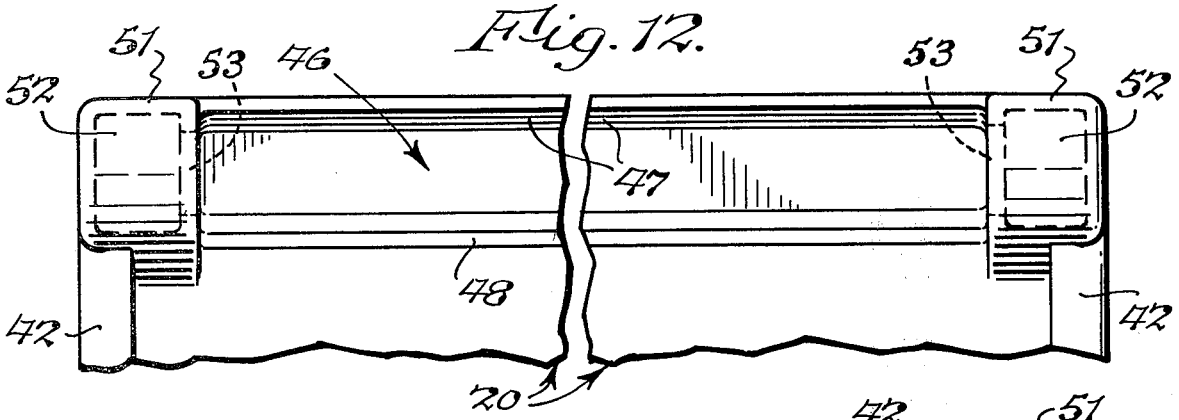
Fig. 12.
Fig. 13.
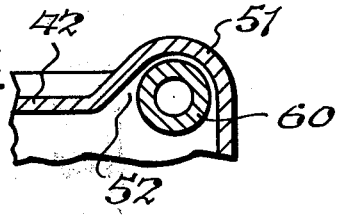
Fig. 14.
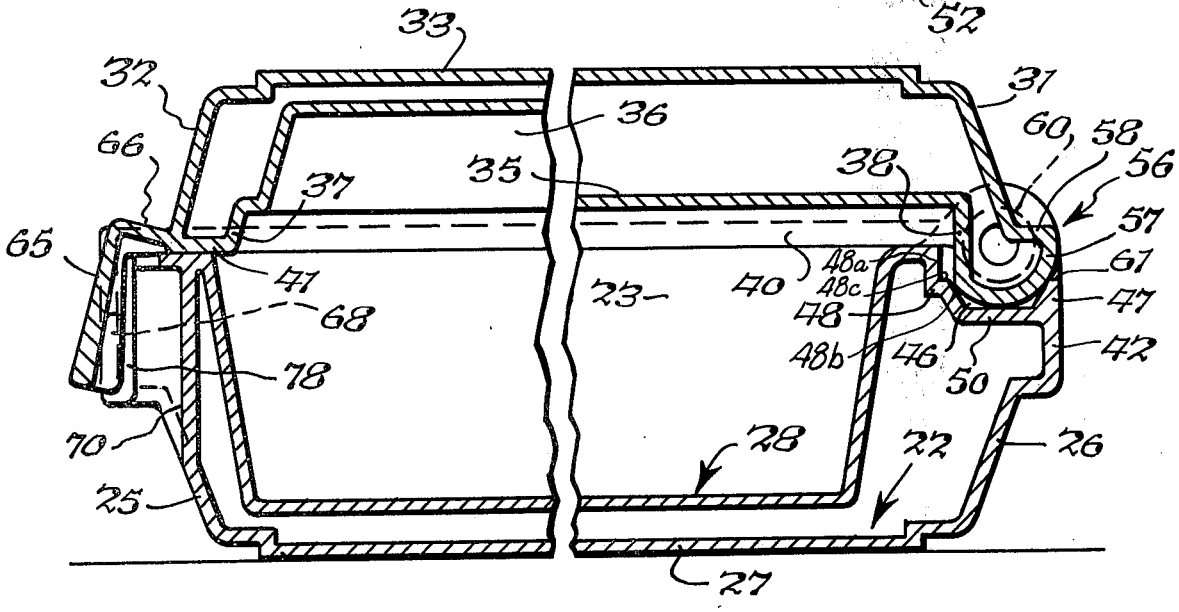

PLASTIC CONTAINER HINGE AND LATCH

This is a division of application Ser. No. 288,707, filed Sept. 13, 1972 and issued as U.S. Pat. No. 3,902,628 on Sept. 2, 1975.

BACKGROUND OF THE INVENTION

This invention relates generally to the plastic container art, and more particularly to a new and improved hinge joint and latch for joining blow molded cover and the body parts and latching them together in closed position.

The forming of separate container bodies and covers offers certain advantages in production and also enables merchandise to be shrink-wrapped in the body prior to assembly of the cover. Moreover, the body and cover can be formed of different materials and colors, as desired. Blow molding such container parts to form double wall constructions also is desirable from various parts of view. For example, the double wall construction provides a cushioned arrangement wherein the inner wall can be shaped to form pockets conforming generally to the shape of the articles to be received therein for packaging. However, a problem arises in hinging such blow molded parts together, particularly in heavy duty applications. While such parts can be separately pinned it is advantageous, where possible, to provide a self-contained hinge construction which can be quickly and easily assembled by either the molder or the packager without need for complex tooling.

Problems also are encountered in providing a suitable latch for such hinged container parts. Where the latch is formed separate from the container parts, an additional assembly step is involved, adding to production costs. While this can be avoided by molding the latch integral with one of the container parts, problems remain in providing a latch of sufficient strength and durability without imposing undesirable design limitations.

SUMMARY OF THE INVENTION

Accordingly, an object of this invention is to provide an improved hinge joint formed integral with blow molded container parts which facilitates assembly without complex tooling, contemplates a wide range of container styling variations, provides a substantially continuous or closed hinge construction to enhance container appearance, and provides a positive stop for the container cover in an open position.

Another object of this invention is to provide an integral latch construction for blow molded container parts which has excellent latching action and securing characteristics, is only moderately stressed during movement between the latched and released positions, and which is esthetically extremely pleasing.

In one aspect thereof, a plastic container of the present invention is characterized by the provision of a blow molded cover having formed as an integral part thereof a pair of hinge pins and a joint formation extending therebetween, and a body having spaced apart hinge pin receiving means and a trough formation extending therebetween receiving the cover joint formation in assembled relation. In another aspect thereof, a plastic container of this invention is characterized by the provision of a latch tongue of tapered side wall form integral with one container part and having snap-in engagement with a recess of tapered side wall form on the other container part for securing the container in closed position.

The foregoing and other objects, advantages, and characterizing features of the present invention will become clearly apparent from the ensuing detailed description of an illustrative embodiment thereof, taken together with the accompanying drawings wherein like reference numerals denote like parts throughout the various views.

BRIEF DESCRIPTION OF THE DRAWING FIGURES

FIG. 11 is a fragmentary top plan view, partially in section, on an enlarged scale, showing the hinge joint formation of this invention;

FIG. 12 is a fragmentary top plan view, on an enlarged scale, of the container body, showing the hinge trough formation therein;

Figure 1:
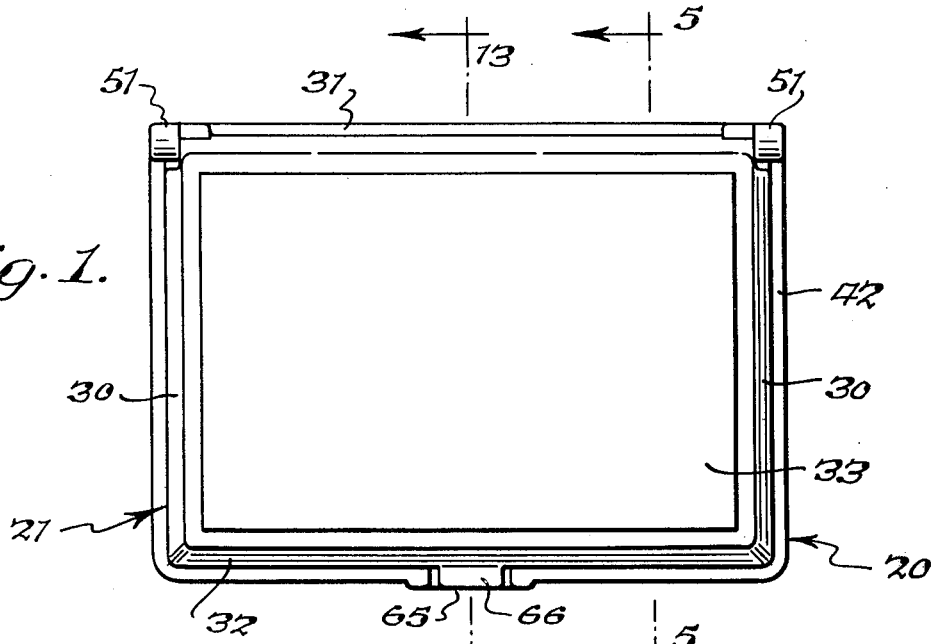
FIG. 1 is a top plan view of an illustratve container embodying the present invention, in closed position.
Figure 2:
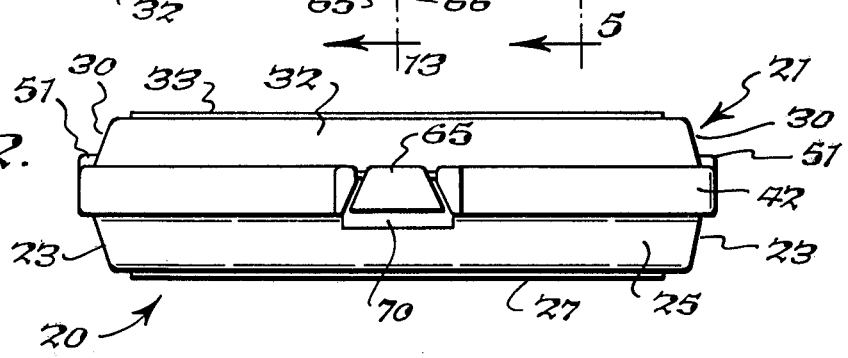
FIG. 2 is a front elevational view thereof.
Figure 3:
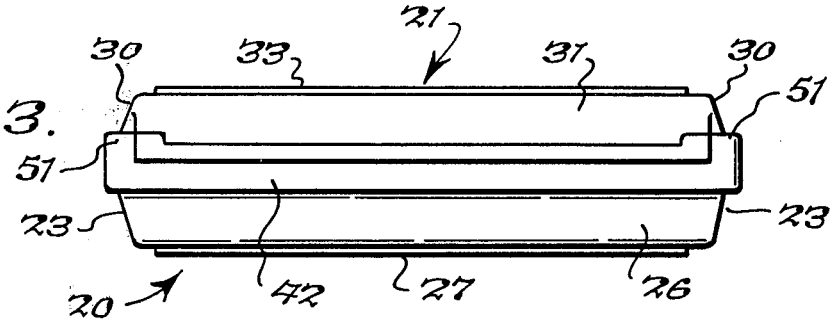
FIG. 3 is a rear elevational view thereof.
Figure 4:
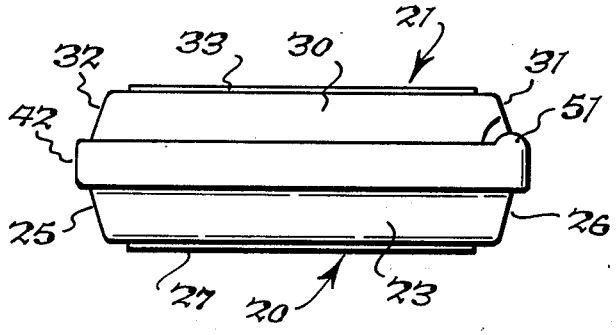
FIG. 4 is a side elevational view thereof.

FIG. 13 is a transverse, cross sectional view, on an enlarged scale, taken about on line 13—13 of FIG. 1 parts being broken away in FIGS. 11, 12 and 13 for convenience in illustration; and FIG. 14 is a fragmentary vertical sectional view, taken about on line 14—14 of FIG. 11.

DETAILED DESCRIPTION OF THE ILLUSTRATED EMBODIMENT

The illustrative container depicted in the accompanying drawings comprises a base or body, generally designated 20, and a lid or cover therefor, generally designated 21. Body 20 is formed of a suitable thermoplastic material blow-molded into the desired shape and having a hollow, double wall construction formed by an outer shell 22 (FIGS. 5 and 13) comprising opposite side walls 23, a front wall 25, a rear wall 26 and a bottom wall 27, and an inner shell 28 formed to provide a generally recessed compartment (FIGS. 5 and 13) within outer shell 22 in spaced relation thereto except adjacent the edge portions thereof where it is connected to the upper edge of the outer shell. If desired, inner shell 28 can extend across the upper end of outer shell 22 and can be compartmented or provided with pockets for receiving variously shaped articles therein. Also, after body 20 is removed from the mold, one or more portions of inner shell 28 can be cut-away, as desired, to provide access to the interior of body 20 between the inner and outer shells for storage or any other purpose.

Cover 21 also is formed of thermoplastic material blow-molded into a hollow, double wall construction defined by an outer shell having opposite side walls 30, a rear wall 31, a front wall 32 and a top wall 33, and an inner shell extending across the outer shell in spaced relation thereto except adjacent the edge portions thereof where it is connected thereto. The cover inner shell has a top wall 35 formed to provide a recessed compartment 36, front and rear walls 37, 38 and opposite side walls 40. A generally horizontal ledge 41 extends outwardly from the outer ends of front wall 37 and side walls 40 and connects the cover inner shell to the outer shell thereof.

The outer shell of body 20 is formed to provide an outwardly offset band 42, extending horizontaly around body 10 adjacent the upper end thereof and the juncture of the outer shell 22 with inner shell 28. The inner shell 28 is formed, adjacent its connection with the outer shell band 42, with a raised shoulder 43 (FIG. 5) extending inwardly from the upper edge of band 42 and terminating at its lower end in a generally horizontal ledge 45 which extends about the upper inner edge of body 10 and against which cover ledge 41 abuts when cover 21 is closed. Thus, the parting line between cover 21 and body 20 at the abutting ledges 41 and 45 is disposed below and concealed by the upper edge of band 42, thereby creating an attractive container appearance.

Figure 5:
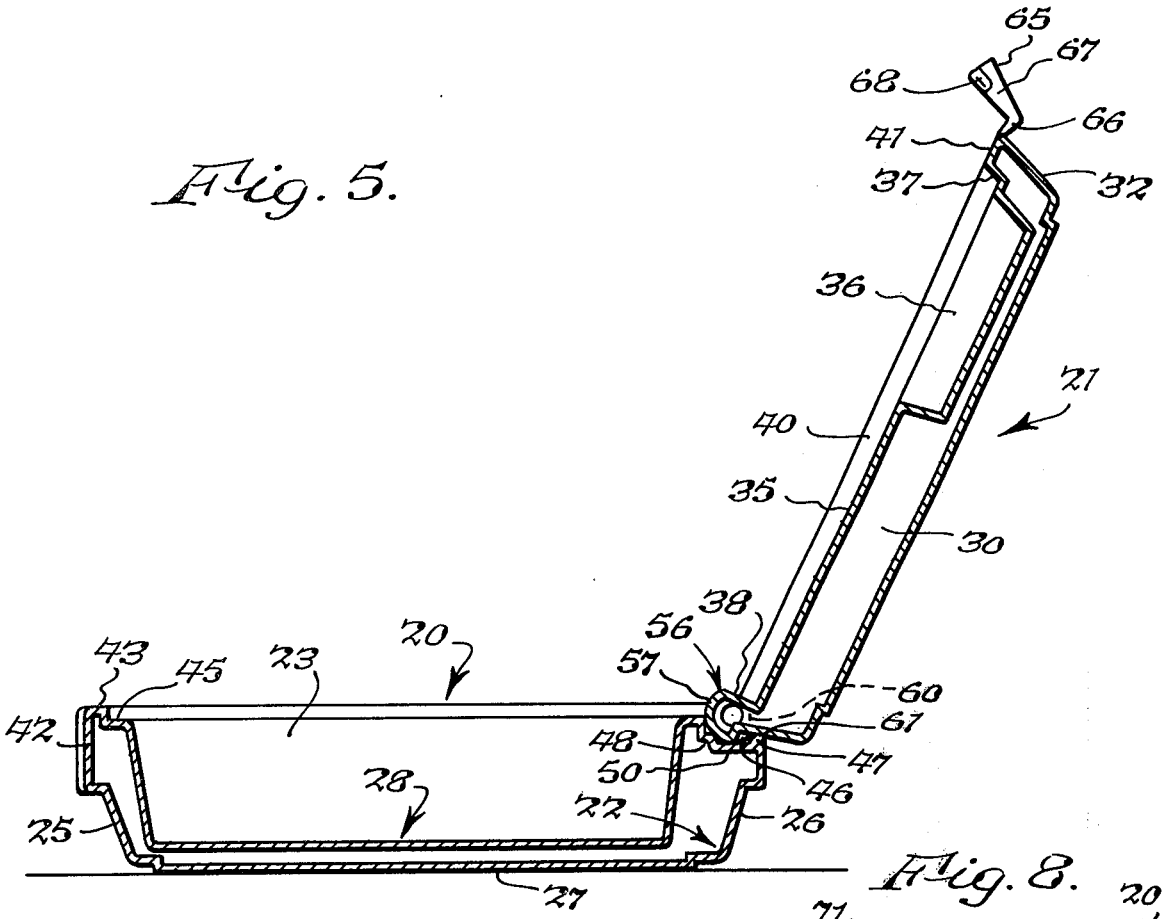
FIG. 5 is a vertical sectional view, on an enlarged scale, taken about on line 5—5 of FIG. 1, showing the container in a fully opened position.
Figure 6:
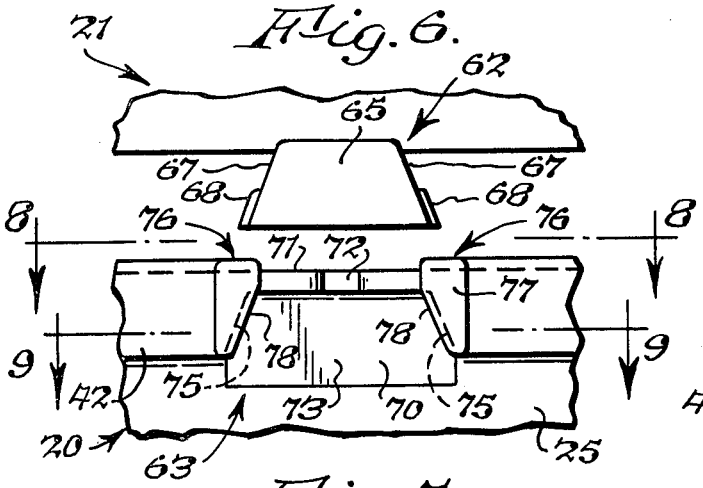
FIG. 6 is a fragmentary front elevational view, on an enlarged scale, showing container in an open position with the latch disengaged.
Figure 7:
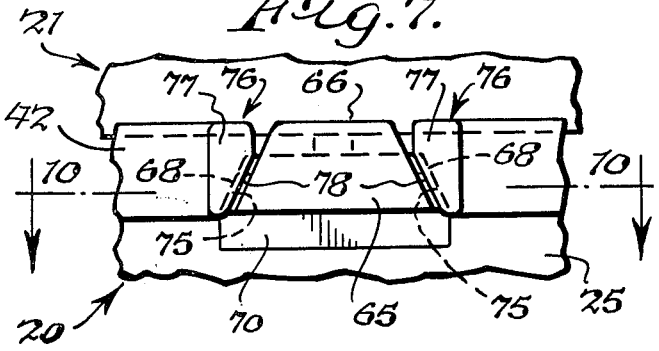
FIG. 7 is a view similar to FIG. 6 but showing the container in closed position with the latch fully engaged and locking the container parts closed.

An important feature of this invention resides in the provision of a closed hinge joint all parts of which are formed with and as an integral part of either the body or the cover. To this end, a trough formation 46 of a generally U-shaped transverse configuration is provided along the upper rear edge of body 20 between ledge 45 and the upper end of body 20 between ledge 45 and the upper end of band 42. As shown in FIGS. 5 and 13, trough formation 46 is a channel defined by an inclined outer wall 47 joined to the upper edge of band 42, a stepped inner wall 48 extending downwardly from the outer edge of ledge 45, and a bottom wall 50 connecting the outer and inner walls 47 and 48. Stepped inner wall 48 as shown in FIG. 13 consists of a vertical portion 48*a*, an inclined portion 48*b* and a short wedge or step portion 48*c*. Elements 48*b*, 50 and 47 form a trapezoidal channel in cross formation 46.

A pair of hollow, bulbous formations or sections 51 are formed integral with the upper, rear edge of body 20 at the opposite ends of trough 46 and are provided with openings 53 through the inner transverse walls thereof which are upstanding at the opposite ends of trough 46 to define inwardly opening sockets 52 therein (FIG. 11) aligned with trough 46 for receiving cover hinge pins, hereinafter described. The inlet openings of sockets 52 are defined by annular walls 55 which serve as hinge pin bearings in the assembled relation.

Container cover 21 is provided with an elongated joint formation 56 formed integral with cover 21 along the lower rear edge thereof. As shown in FIGS. 5 and 13, joint formation 56 is hollow and is formed in part by the outer portion of the inner shell rear wall 38 and an arcuately curved wall portion 57 connected to outer shell rear wall 31 by a straight wall portion 58. A pair of coaxially aligned hollow hinge pins 60 also are formed integral with joint formation 56 and project axially outwardly from the opposite ends thereof so as to be oppositely directed. Wall portion 57 is curved on a radius about the axis of hinge pins 60, such radius being larger than the radius of hinge pins 60.

When cover 21 and body 20 are assembled, the cover joint formation 56 is received in trough formation 46 and hinge pins 60 project through openings 53 into sockets 52 the walls 55 of which serve as hinge pin bearings when cover 21 is swung between open and closed positions. In assembly cover 21 to container body 20, the inherent resliency of the plastic material of which body 20 and cover 21 are formed permits both to be flexed sufficiently to allow the passage of hinge pins 60 past the opposed faces at socket formations 57 and into sockets 52 for pivotal engagement therein. Thus, cover 21 is easily attached to body 20 by a simple mechanical fixture without the use of complex tooling and without need for hinge parts separate from the molded container parts. When cover 21 and body 20 are assembled, joint formation 56 extends into trough 46 for the full length thereof between sockets 52. As shown in FIG. 13 the configuration of the arcuate curved wall portion 57 of the joint formation 56 is such that when the cover is closed, portion 57 is located in the channel defined by walls 48*b* and 47 and bottom wall 50. When the cover is raised as shown in FIG. 5, arcuate curved wall portion 57 contacts vertical wall portion 48*a*, inclined portion 48*c* and bottom wall 50. Thus the configuration of joint formation 56 is such that a portion of the full length thereof is disposed within the channel of trough formation 46, below the upper plane of body 20, at all positions of cover 21. This, together with the concealment of hinge pins 60 within sockets 52 effects a substantially continuous hinge joint which as viewed from the inside or open position of the container is closed at all times during opening and closing of cover 21, as clearly apparent from FIGS. 5 and 12. This closed hinge construction eliminates the usual gap or open spaces commonly found between the bodies and covers of conventional containers in an open position and greatly enhances the appearance of the container. Furthermore, this closed hinge construction permits numerous container styling variations to be made without detracting from the overall appearance of the container.

Another advantage residing in the closed hinge construction of this invention is in the provision of a positive stop for cover 21 at a predetermined open position. As shown in FIG. 5, the inwardly offset orientation of outer shell rear wall 31 relative to arcuate wall portion 57, together with the upper recessed edge 61 of band 42 along the rear end of body 20, enables cover 21 to be swung past 90°, for example to about 120°, for more convenient access into body 20. However, at the full open position, rear wall 31 engages the recessed edge 61 of band 42, limiting further opening of cover 21. The flat rear wall 38 of the cover inner shell provides clearance assuring proper closing of cover 21 without interference with any other portion of body 20. Hinge pins 60 are of relatively large diameter, several times the wall thickness of the container, for greater bearing area and strength.

Another significant feature of the present invention resides in the latching arrangement provided thereby. As shown in FIGS. 6–10 and 13, a latch member, generally designated 62, is formed integral with the lower edge of cover front wall 32 for reception into an associated latch receiving means, generally designated 63, provided along the upper portion of body front wall 25 for releasably locking cover 21 to body 20 in closed position. It should be appreciated that in larger, heavier container constructions, two or more latches with corresponding latch receiving means can be provided, as desired.

Latch member 62 comprises a tongue 65 of a generally trapezoidal outline having tapered side edges extending toward cover 21 in a converging relation and joined to cover 21 by a connecting flange portion 66 formed integral with the upper end of tongue 65 and with the lower edge of cover front wall 32. Flange 66 projects forwardly of cover front wall 32 and serves as a pivotal, hinge connection for swinging tongue 65 through relatively small arcuate movements. Tongue 65 is provided with a pair of inturned side walls 67 extending substantially the length of the tapered side edges thereof and of progressively increasing width from the upper end of tongue 65 to the bottom end thereof. Also, the wall thickness of tongue 65 progressively increases from the top to the bottom thereof. Cover 21 and body 20 are blow molded, as by trapping a portion of a parison of thermoplastic material between a pair of mold sections and expanding the same into conformance with the mold faces, in a manner well known in the art. Tongue 65 is formed with cover 21 by compressing together opposite wall portions of the trapped material during the blow molding operation to form a tongue wall which is thicker, in part at least, than the individual wall thickness of the trapped material or the walls of the finished container parts. Each side wall 67 is formed with a laterally projecting bead or protuberance 68 for a purpose to the explained.

Figure 8:
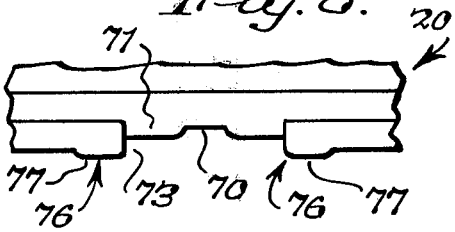
FIG. 8 is a fragmentary top plan view of the container body, looking in the direction of arrows 8—8 in FIG. 7.
Figure 9:
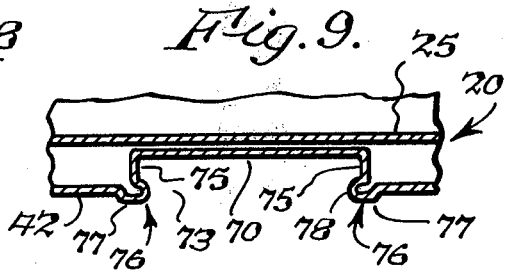
FIG. 9 is a fragmentary horizontal sectional view, taken about on line 9—9 of FIG. 6.
Figure 10:
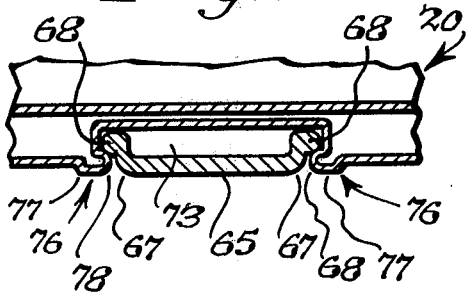
FIG. 10 is a fragmentary horizontal sectional view, taken about on line 10—10 of FIG. 7.

The upper central portion of container body front wall 25 is formed with a slight recess, as defined by a generally vertical wall surface 70 (FIG. 13) terminating at its upper end in an outwardly directed ledge 71 having a central recess 72 therein (FIG. 8). Also, the outwardly offset band 42 is discontinuous adjacent the central portion of body front wall 25, forming a recess 73 defined by a pair of axially spaced, tapered walls 75 extending inwardly to the plane of vertical wall surface 70 to form the latch receiving means 63 of this invention. Walls 75 are inclined toward cover 21 in a converging relation corresponding to the tapered side edge form of tongue 65 to accommodate the latter in the latched position. A pair of shoulders 76 are formed at the juncture of band 42 with walls 75 and have outer portions 77 projecting forwardly out of the plane of band 42 and inner edge portions 78 projecting inwardly from walls 75 into recess 73 to provide undercut recesses in the side walls defining recess 73. These undercut shoulders 76 are blow molded with and as an integral part of container body 20 and complete the latch receiving means 63 of this invention.

When cover 21 is pivoted into a closed position with the cover ledge 41 confined within band 42 and abutting container body ledge 45, tongue 65 lies in its normal plane of repose with the major portion thereof disposed outwardly of recess 73 and with locking beads 68 positioned adjacent the outer portions 77 of shoulders 76, as shown in FIG. 13. In order to latch cover 21 in this closed position, tongue 65 is depressed toward body 20, and pivoted inwardly into recess 73 about a horizonal axis defined at the juncture of connecting flange 66 and the lower end of cover front wall 32. The inherent resiliency of the plastic material forming the latch permits the passage of beads 68 past the inwardly directed portions 78 of shoulders 76 and into the undercut recess 73 behind shoulders 76 with a snap-fit engagement (FIG. 10), the inner portions 78 of shoulders 76 resiliently yielding and deforming to permit snap passage of beads 68 through the restricted inlet defined between shoulder inner portions 78. Once assembled, the engagement of beads 68 behind shoulders 76 precludes accidental removal of latching tongue 65 from recess 63. Any force tending to move cover 21 upwardly, away from container body 20, is resisted by the wedging coaction between the tapered walls 75 of band 42 and the inclined side walls 67 of tongue 65, and tends to more securely lock tongue 65 in place.

When latch member 62 is in the latched position wih tongue 65 within recess 73 and beads 68 engaged behind shoulders 76, latch member 62 lies closely adjacent its natural plane of repose whereby it is not under any significant stress. Ledge 71 offers a measure of support to latch portion 66 in latched position. Latching beads 68 are snapped past shoulders 76 by depressing or lifting tongue 65 to latch and release the container cover 21. In the latched position, the lower edge of tongue 65 is sufficiently spaced from the vertical wall surface 70 to permit insertion of the user's thumb or finger to readily lift or release tongue 65 from recess 73. As shown in FIG. 13, tongue 65 extends at about a right angle to the connecting hinge 66 which is molded at a slight, e.g. 20° upward angle to cover ledge 41, whereby in its natural condition of repose tongue 65 just clears the associated body portions 76 as cover 21 is moved into closed position. Tongue 65 therefore is flexed through a relatively small or angle during latching and unlatching movement thereof so as to produce only a minimum of stress and strain thereon. Moreover, this short pivotal movement facilitates dimensional accuracy in positioning tongue 65 in the desired holding position. As a result, latch member 62 is assured a relatively long useful life, assuming normal usage thereof, and requires only to be formed of a suitable tear resistant material, such as polyethylene or polypropylene, for example, having a long flex life.

The container parts, including the hinge joint and the latch, can be made of any suitable thermoplastic material, such as high density polyethylene and polypropylene, which are given by way of example only. It should be understood that the hinge joint and latch of this invention are not dependent upon or limited to use with each other, nor are they intended to be limited in use with the specific container described and illustrated, but have utility, whether taken together or separately, in a wide variety of applications where it is desired to hingedly mount one part to another and/or releasably latch them together.

Also, it will be appreciated that the foregoing detailed description is given by way of illustration only, and that trough 46, for example, can be of curved rather than straight wall form.

From the foregoing, it is apparent that the objects of the present invention have been fully accomplished. There is provided an improved closed hinge construction formed integral with the container parts for simplicity and enhancing the appearance of the container while permitting a wide range of container styling variations. A latch member is formed integral with the cover and offers improved latching action while permitting a wide range of styling variation.

I claim:

1. A container comprising a body portion being of double wall thermoplastic material having a pair of hinge pin receiving means, each said hinge pin receiving means being integrally formed with said body portion into a hollow journal bearing, and a trough formation being integrally formed with said body and including a lower channel extending between said hinge pin receiving means in a continuous manner, a cover portion of thermoplastic material, said cover portion being of double wall construction and having formed as an integral part thereof a pair of hinge pin journals, and a joint formation extending between said hinge pin journals, said joint formation including a portion received in said trough formation with said hinge pin journals being correspondingly received in said journal bearings whereby said joint formation of said cover portion co-acts with said lower channel of said trough formation to provide a hinge joint, said hinge joint being closed in all open positions of said cover portion as viewed from within said open positions.

2. A container as set forth in claim 1, wherein said joint formation of said cover is hollow and has an arcuately curved wall portion which is exposed to view as said cover portion is moved from closed to open position, said wall portion being curved on a radius about the axis of said hinge pin journals and larger than the radius of said hinge pin journals.

3. A container as set forth in claim 1 wherein each said journal bearing includes a bore extending only through a wall portion of said container body which is adjacent to said cover portion wherein each said bore lies in a plane substantially perpendicular to the axis of said hinge pins.

4. A container as set forth in claim 1, wherein said trough formation is defined by a front and rear wall joined together by a bottom wall, said rear wall being recessed and providing a stop for said cover portion at a predetermined open position thereof.

5. A container as set forth in claim 4, said joint formation being disposed within said trough formation in all positions of said cover portion.

6. A container as set forth in claim 1 wherein said body portion and said cover portion are provided with mating edges adapted to abut in the closed position of said cover portion, and a peripheral band adjacent the upper end of said body portion concealing the parting line of said mating edges when engaged.

* * * * *